US012480682B2

(12) United States Patent
Searle et al.

(10) Patent No.: US 12,480,682 B2
(45) Date of Patent: Nov. 25, 2025

(54) DISPLACEMENT DIFFUSER

(71) Applicant: Air Distribution Technologies IP, LLC, Milwaukee, WI (US)

(72) Inventors: Nicholas James Searle, Cumming, GA (US); Kenneth Jay Loudermilk, Johns Creek, GA (US); Matthew Brent McLaurin, Carrollton, TX (US); Ryan Michael Perkinson, Plano, TX (US); Brian Joseph Graham, Mansfield, TX (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 429 days.

(21) Appl. No.: 17/961,841

(22) Filed: Oct. 7, 2022

(65) Prior Publication Data

US 2023/0114547 A1 Apr. 13, 2023

Related U.S. Application Data

(60) Provisional application No. 63/253,955, filed on Oct. 8, 2021.

(51) Int. Cl.
*F24F 13/06* (2006.01)

(52) U.S. Cl.
CPC ..... *F24F 13/06* (2013.01); *F24F 2013/0612* (2013.01)

(58) Field of Classification Search
CPC ..... F24F 13/06; F24F 2013/0612
USPC ..... 454/296, 185, 188, 56
See application file for complete search history.

(56) References Cited

U.S. PATENT DOCUMENTS

| | | | | |
|---|---|---|---|---|
| 4,711,162 | A | 12/1987 | Eriksson | |
| 6,986,708 | B2 * | 1/2006 | Demster | F24F 11/77 454/248 |
| 7,013,969 | B1 | 3/2006 | Loudermilk | |
| 9,625,166 | B2 | 4/2017 | Hirsch et al. | |
| 9,982,899 | B2 | 5/2018 | McCarty | |
| 10,365,003 | B2 | 7/2019 | Livchak et al. | |

(Continued)

FOREIGN PATENT DOCUMENTS

| | | | |
|---|---|---|---|
| CA | 2791115 | A1 | 3/2014 |
| CA | 2844001 | C | 8/2016 |

(Continued)

*Primary Examiner* — Avinash A Savani
*Assistant Examiner* — Dana K Tighe
(74) *Attorney, Agent, or Firm* — Michael Best & Friedrich LLP

(57) ABSTRACT

A diffuser for a heating, ventilation, and air conditioning (HVAC) system includes a housing defining a plenum chamber, where the housing comprises a diffusion plate configured to direct a first air flow into the plenum chamber and to discharge a second air flow from the plenum chamber and a plenum plate disposed within the housing, where the plenum plate extends from a first side of the housing to a second side of the housing opposite the first side, and the plenum plate divides the plenum chamber into a first chamber and a second chamber. The diffuser includes a plurality of apertures disposed along the plenum plate, where the plurality of apertures is configured to direct a third air flow from the first chamber into the second chamber to draw the first air flow into the plenum chamber and to force the second air flow out of the plenum chamber.

18 Claims, 9 Drawing Sheets

(56) References Cited

U.S. PATENT DOCUMENTS

| | | | |
|---|---|---|---|
| 2006/0211365 | A1 | 9/2006 | Petrovic |
| 2009/0264062 | A1 | 10/2009 | Miller et al. |
| 2020/0309390 | A1 | 10/2020 | Perkinson et al. |
| 2021/0041131 | A1* | 2/2021 | Arcarons Alibes ..... F24F 13/0236 |

FOREIGN PATENT DOCUMENTS

| | | | |
|---|---|---|---|
| DE | 29501366 | U1 | 3/1995 |
| EP | 1637815 | B1 | 4/2011 |

* cited by examiner

DISPLACEMENT DIFFUSER

CROSS-REFERENCE TO RELATED APPLICATIONS

This application claims priority from and the benefit of U.S. Provisional Application No. 63/253,955, entitled "DISPLACEMENT DIFFUSER," filed Oct. 8, 2021, which is hereby incorporated by reference in its entirety for all purposes.

BACKGROUND

This section is intended to introduce the reader to various aspects of art that may be related to the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial applications to control environmental properties, such as temperature and humidity, for occupants of respective environments. An HVAC system may control the environmental properties through control of properties of an air flow delivered to and ventilated from spaces serviced by the HVAC system. For example, the HVAC system may transfer heat between the air flow and refrigerant flowing through the system (e.g., a heat exchanger) to provide cooled air for an indoor environment. Similarly, the HVAC system may heat the air flow to provide warmth to an indoor environment. In some situations, the HVAC system may cool the air flow and then heat the air flow to reduce humidity of the air flow while providing air at a desired temperature to the indoor environment. The HVAC system may also control a flow rate of the air flow to manage (e.g., expedite transitioning between) environmental conditions.

Air diffusers may be included in an HVAC system to distribute air from a ductwork system into an interior space (e.g., room) of a building. Typically, air diffusers are mounted within the interior space and may be coupled to an outlet of a duct that is configured to transfer conditioned air to the interior space. Unfortunately, existing air diffusers are susceptible to poor performance. For example, existing air diffusers may provide inefficient or inadequate conditioning of an interior space, limited ventilation of air within the interior space, and/or inadequate distribution of air supplied to the interior space. Additionally, certain existing air diffusers may be expensive to implement with HVAC systems. Accordingly, it is now recognized that improved air diffusers are desired.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a diffuser for a heating, ventilation, and air conditioning (HVAC) system includes a housing defining a plenum chamber, where the housing comprises a diffusion plate configured to direct a first air flow into the plenum chamber and to discharge a second air flow from the plenum chamber and a plenum plate disposed within the housing, where the plenum plate extends from a first side of the housing to a second side of the housing opposite the first side, and the plenum plate divides the plenum chamber into a first chamber and a second chamber. The diffuser also includes a plurality of apertures disposed along the plenum plate, where the plurality of apertures is configured to direct a third air flow from the first chamber into the second chamber to draw the first air flow into the plenum chamber and to force the second air flow out of the plenum chamber.

In another embodiment, a heating, ventilation, and air conditioning (HVAC) system includes a diffuser configured to receive a first air flow from an air handling unit via ductwork, a housing of the diffuser, where the housing defines an interior chamber and comprises a diffusion plate, and a plenum plate of the diffuser, where the plenum plate is disposed within the housing and divides the interior chamber into a first chamber and a second chamber, and the plenum plate comprises a stepped configuration with a plurality of first panels and a plurality of second panels disposed in an alternating arrangement. The system further includes a plurality of apertures formed in the plurality of second panels of the plenum plate, where the plurality of apertures is configured to direct the first air flow from the first chamber to the second chamber to induce a second air flow into the interior chamber and to discharge a third air flow from the interior chamber.

In another embodiment, a heating, ventilation, and air conditioning (HVAC) system includes an air handling unit configured to provide a first air flow and a diffuser configured to receive the first air flow, induce a second air flow from a conditioned space and into the diffuser, and discharge a third air flow from the diffuser to the conditioned space. The diffuser includes a housing defining a plenum chamber, a plenum plate configured to divide the plenum chamber into a first chamber and a second chamber, and a plurality of apertures formed in the plenum plate and configured to direct the first air flow from the first chamber to the second chamber to induce the second air flow and to discharge the third air flow, where the diffuser is configured to discharge the third air flow vertically below the second air flow induced into the diffuser.

BRIEF DESCRIPTION OF THE DRAWINGS

Various aspects of the present disclosure may be better understood upon reading the following detailed description and upon reference to the drawings, in which.

DETAILED DESCRIPTION

Figure 1:
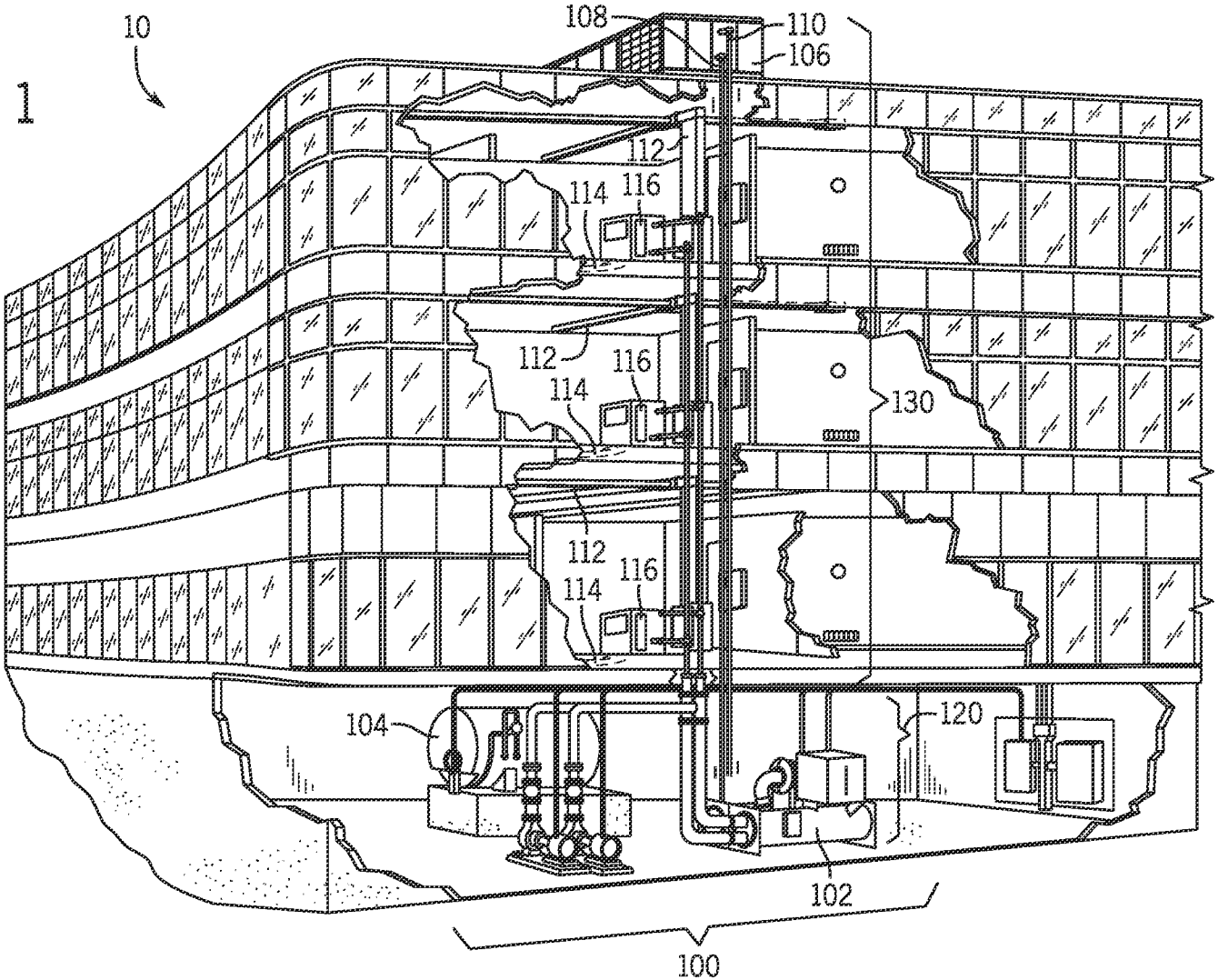
FIG. 1 is a perspective view of an embodiment of a building including a heating, ventilation, and air conditioning (HVAC) system, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

It is now recognized that traditional methods and components of HVAC systems employing air diffusers provide inefficient conditioning and/or limited ventilation of conditioned spaces. Additionally, existing systems are typically expensive. Thus, it is now recognized that improved air diffusers are desired. Accordingly, the present disclosure is directed to an improved air displacement diffuser configured to establish a heat exchange relationship between warm air present in a conditioned space and cold, conditioned air supplied via a supply duct. The displacement diffusers disclosed herein enable an HVAC system to provide conditioned air at a comfortable temperature to occupants in the conditioned space without incorporating certain additional components (e.g., additional heat exchanger, heat wheel, etc.) into the HVAC system. Present embodiments also enable improved ventilation and circulation of air within the conditioned space, which enables enhanced removal of airborne contaminants within the conditioned space. More specifically, the present disclosure is directed to a displacement diffuser (e.g., thermal air displacement diffuser) for an HVAC system configured to employ thermal displacement diffusion techniques. The displacement diffuser may be positioned at or near a floor of a room in a building or other conditioned space and may be configured to supply a cooled, conditioned air flow to the room at a low velocity. Depending on the environment in which the HVAC system is operating (e.g., humid environment, dry environment), the cooled, conditioned air flow may be further cooled to a particular threshold temperature to provide desired dehumidification of the air flow. However, air supplied at the threshold temperature (e.g., 54° F.) may be colder than desired for occupant comfort if the air flow is delivered directly to the room without further conditioning.

Thus, the presently disclosed displacement diffusers may include a plenum chamber with a high pressure chamber configured to receive a pressurized, conditioned air flow and a low pressure mixing chamber configured to induce a flow of warmer air from within a room. The displacement diffuser may mix the warmer air with the conditioned air flow to generate a mixed air flow (e.g., supply air flow) that is supplied to the room. The displacement diffuser may be connected (e.g., fluidly coupled) to a ductwork system of the HVAC system that provides pressurized ducted air (e.g., primary air, conditioned air) to the high pressure chamber. The plenum chamber includes a plenum plate disposed therein, and the plenum plate divides the plenum chamber into the high pressure chamber and the low pressure mixing chamber. The plenum plate may include apertures that direct jets (e.g., flows) of the ducted or primary air into the low pressure mixing chamber. The apertures are configured to increase the velocity of the air flowing into the mixing chamber (e.g., by formation of vena contracta). In other words, the apertures may reduce the cross sectional area of the jets of air downstream of the apertures, which may increase the velocity of the air flow directed into the mixing chamber. In this way, the displacement diffuser is configured to create an induction effect within the mixing chamber. The jets or flows of air directed into the mixing chamber may further mix with still air present in the mixing chamber.

Further, the induction effect enables the displacement diffuser to draw air (e.g., ambient room air, warmer air) from the room (e.g., a lower region of the room) into the mixing chamber through an upper section of a diffusion face plate of the displacement diffuser that is exposed to the room. The ambient air from the room may also mix with the conditioned air in the mixing chamber to generate the supply air flow at a desired temperature (e.g., a higher temperature than that of the conditioned air supplied via the ductwork). The mixed air within the mixing chamber may be colder than the ambient air within the room and may have a higher density and/or pressure than the ambient room air. Thus, the mixed air may be discharged from the displacement diffuser as the supply air flow into the room through a lower section of the diffusion face plate (e.g., at a low velocity). For example, the supply air flow may be discharged along a floor of the room. The supply air flow provided to the room ultimately mixes with ambient air in the room and establishes comfortable environmental conditions for the occupants therein. As the air within the room increases in temperature, the air rises within the room and is discharged via exhaust vents or ducts disposed at or near a ceiling of the room. In this way, airborne contaminants within the room may be effectively removed from the room (e.g., without being recirculated to or within the room).

In view of the foregoing, present embodiments, as compared to traditional HVAC systems employing diffusers, may provide an improved, more efficient, and more cost-effective solution for providing a supply air flow at a comfortable temperature and humidity level to a room, while also enabling improved ventilation of air within the room.

Turning now to the drawings, FIG. 1 illustrates a perspective view of a building 10. The building 10 is served by a heating, ventilating, or air conditioning (HVAC) system 100. The HVAC system 100 can include a plurality of HVAC devices (e.g., heaters, chillers, air handling units, pumps, fans, thermal energy storage, etc.) configured to provide heating, cooling, air conditioning, ventilation, and/or other services for the building 10. For example, the HVAC system 100 is shown to include a waterside system 120 and an airside system 130. The waterside system 120 may provide a heated or chilled fluid to an air handling unit of the airside system 130. The airside system 130 may use the heated or chilled fluid to heat or cool an air flow provided to the building 10.

The HVAC system 100 is shown to include a chiller 102, a boiler 104, and a rooftop air handling unit (AHU) 106. The waterside system 120 may use the boiler 104 and the chiller 102 to heat or cool a working fluid (e.g., water, glycol, etc.) and may circulate the working fluid to the AHU 106. In various embodiments, the HVAC devices of the waterside system 120 can be located in or around the building 10 (as shown in FIG. 1) or at an offsite location such as a central plant (e.g., a chiller plant, a steam plant, a heat plant, etc.) that serves one or more buildings including the building 10. The working fluid can be heated in the boiler 104 or cooled in the chiller 102, depending on whether heating or cooling is required in the building 10. The boiler 104 may add heat to the circulated fluid, for example, by burning a combustible material (e.g., natural gas) or using an electric heating element. The chiller 102 may place the circulated fluid in a heat exchange relationship with another fluid (e.g., a refrigerant) in a heat exchanger (e.g., an evaporator) to absorb heat from the circulated fluid. The working fluid from the chiller 102 and/or the boiler 104 can be transported to the AHU 106 via piping 108.

The AHU 106 may place the working fluid in a heat exchange relationship with an air flow passing through the AHU 106 (e.g., via one or more stages of cooling coils and/or heating coils). The air flow can be, for example, outside air, return air from within the building 10, or a combination of both. The AHU 106 may transfer heat between the air flow and the working fluid to provide heating or cooling for the air flow. For example, the AHU 106 can include one or more fans or blowers configured to pass the air flow over or through a heat exchanger containing the working fluid. The working fluid may then return to the chiller 102 or the boiler 104 via piping 110.

The airside system 130 may deliver the air flow supplied by the AHU 106 (i.e., the supply air flow) to the building 10 via air supply ducts 112 and may provide return air from the building 10 to the AHU 106 via air return ducts 114. In some embodiments, the airside system 130 includes multiple variable air volume (VAV) units 116. For example, the airside system 130 is shown to include a separate VAV unit 116 on each floor or zone of the building 10. The VAV units 116 can include dampers or other flow control elements that can be operated to control an amount of the supply air flow provided to individual zones of the building 10. In other embodiments, the airside system 130 delivers the supply air flow into one or more zones of the building 10 (e.g., via the supply ducts 112) without using intermediate VAV units 116 or other flow control elements. The AHU 106 can include various sensors (e.g., temperature sensors, pressure sensors, etc.) configured to measure attributes of the supply air flow. The AHU 106 may receive input from sensors located within the AHU 106 and/or within the building zone and may adjust the flow rate, temperature, or other attributes of the supply air flow through the AHU 106 to achieve setpoint conditions for the building zone.

Figure 2:
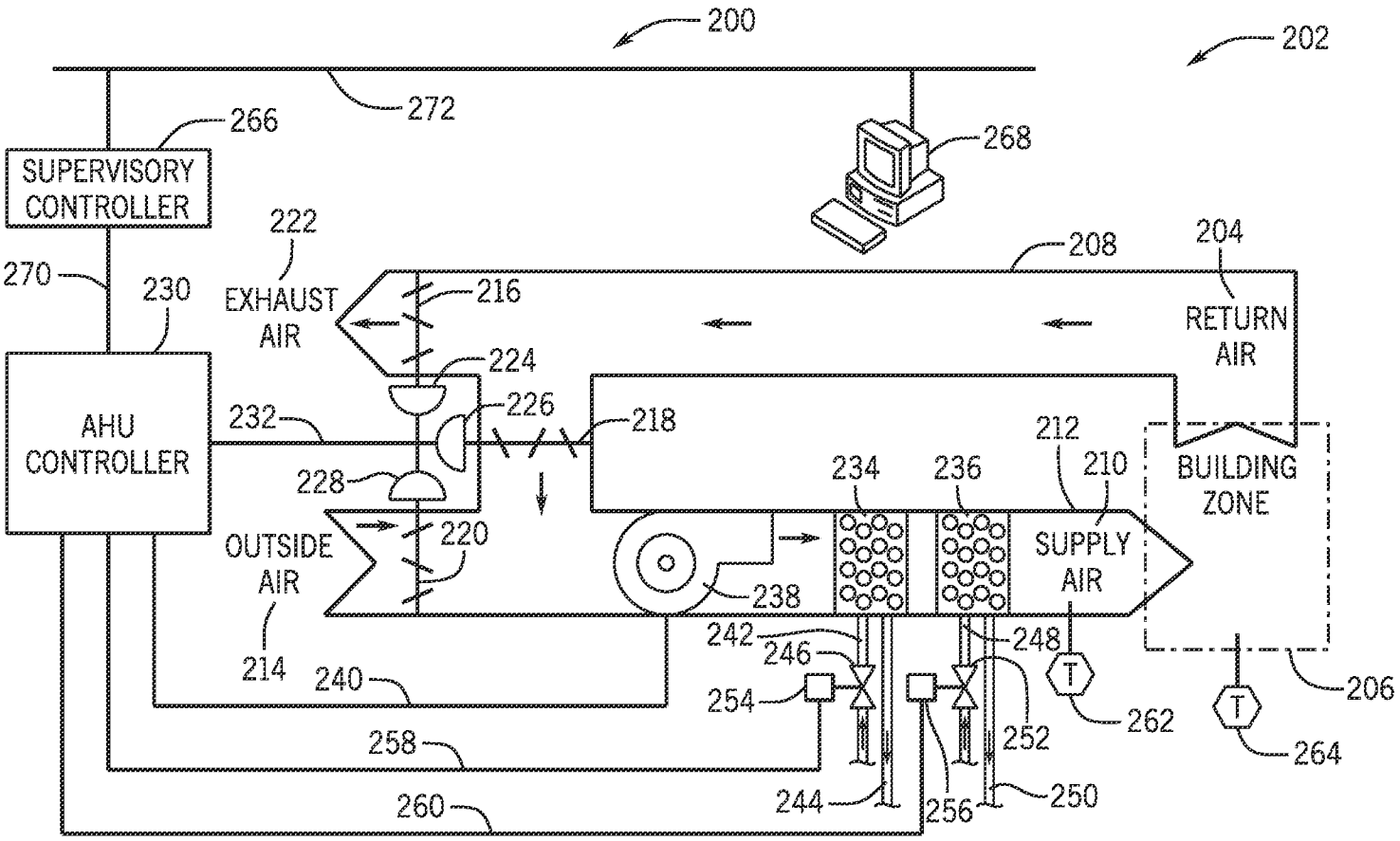
FIG. 2 is a block diagram of an embodiment of an airside system including an air handling unit (AHU) of an HVAC system, in accordance with an aspect of the present disclosure.

Referring now to FIG. 2, a block diagram of an airside system 200 is shown, according to some embodiments. In various embodiments, the airside system 200 may supplement or replace the airside system 130 in the HVAC system 100 or can be implemented separate from the HVAC system 100. When implemented in the HVAC system 100, the airside system 200 can include a subset of the HVAC devices in the HVAC system 100 (e.g., the AHU 106, the VAV units 116, the ducts 112-114, fans, dampers, etc.) and can be located in or around the building 10. The airside system 200 may operate to heat or cool an air flow provided to the building 10 using a heated or chilled fluid provided by the waterside system 120.

In FIG. 2, the airside system 200 is shown to include an economizer-type air handling unit (AHU) 202. Economizer-type AHUs vary the amount of outside air and return air used by the air handling unit for heating or cooling. For example, the AHU 202 may receive return air 204 from building zone 206 via return air duct 208 and may deliver supply air 210 to building zone 206 via supply air duct 212. In some embodiments, the AHU 202 is a rooftop unit located on the roof of the building 10 (e.g., the AHU 106 as shown in FIG. 1) or otherwise positioned to receive both the return air 204 and the outside air 214. The AHU 202 can be configured to operate an exhaust air damper 216, a mixing damper 218, and an outside air damper 220 to control an amount of the outside air 214 and the return air 204 that combine to form the supply air 210. Any return air 204 that does not pass through the mixing damper 218 can be exhausted from the AHU 202 through the exhaust damper 216 as exhaust air 222.

Each of the dampers 216-220 can be operated by an actuator. For example, the exhaust air damper 216 can be operated by an actuator 224, the mixing damper 218 can be operated by an actuator 226, and the outside air damper 220 can be operated by an actuator 228. The actuators 224-228 may communicate with an AHU controller 230 via a communications link 232. The actuators 224-228 may receive control signals from the AHU controller 230 and may provide feedback signals to the AHU controller 230. Feedback signals can include, for example, an indication of a current actuator or damper position, an amount of torque or force exerted by the actuator, diagnostic information (e.g., results of diagnostic tests performed by the actuators 224-228), status information, commissioning information, configuration settings, calibration data, and/or other types of information or data that can be collected, stored, or used by the actuators 224-228. The AHU controller 230 can be an economizer controller configured to use one or more control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control the actuators 224-228.

Still referring to FIG. 2, the AHU 202 is shown to include a cooling coil 234, a heating coil 236, and a fan 238 positioned within the supply air duct 212. The fan 238 can be configured to force the supply air 210 through the cooling coil 234 and/or the heating coil 236 and provide the supply air 210 to the building zone 206. The AHU controller 230 may communicate with the fan 238 via a communications link 240 to control a flow rate of the supply air 210. In some embodiments, the AHU controller 230 controls an amount of heating or cooling applied to the supply air 210 by modulating a speed of the fan 238.

The cooling coil 234 may receive a chilled fluid from the waterside system 120 (via piping 242 and may return the chilled fluid to the waterside system 120 via piping 244. A valve 246 can be positioned along the piping 242 or the piping 244 to control a flow rate of the chilled fluid through the cooling coil 234. In some embodiments, the cooling coil 234 includes multiple stages of cooling coils that can be independently activated and deactivated (e.g., by the AHU controller 230, by a supervisory controller 266, etc.) to modulate an amount of cooling applied to the supply air 210.

The heating coil 236 may receive a heated fluid from the waterside system 120 via piping 248 and may return the heated fluid to the waterside system 120 via piping 250. A valve 252 can be positioned along the piping 248 or the piping 250 to control a flow rate of the heated fluid through the heating coil 236. In some embodiments, the heating coil 236 includes multiple stages of heating coils that can be independently activated and deactivated (e.g., by the AHU controller 230, by the supervisory controller 266, etc.) to modulate an amount of heating applied to the supply air 210.

Each of the valves 246 and 252 can be controlled by an actuator. For example, the valve 246 can be controlled by an actuator 254, and the valve 252 can be controlled by an actuator 256. The actuators 254-256 may communicate with the AHU controller 230 via communications links 258-260. The actuators 254-256 may receive control signals from the AHU controller 230 and may provide feedback signals to the AHU controller 230. In some embodiments, the AHU controller 230 receives a measurement of the supply air temperature from a temperature sensor 262 positioned in the supply air duct 212 (e.g., downstream of the cooling coil 234 and/or the heating coil 236). The AHU controller 230 may also receive a measurement of the temperature of the building zone 206 from a temperature sensor 264 located in the building zone 206.

In some embodiments, the AHU controller 230 operates the valves 246 and 252 via the actuators 254-256 to modulate an amount of heating or cooling provided to the supply air 210 (e.g., to achieve a setpoint temperature for the supply air 210 or to maintain the temperature of the supply air 210 within a setpoint temperature range). The positions of the valves 246 and 252 affect the amount of heating or cooling provided to the supply air 210 by the cooling coil 234 or the heating coil 236 and may correlate with the amount of energy consumed to achieve a desired supply air temperature. The AHU controller 230 may control the temperature of the supply air 210 and/or the building zone 206 by activating or deactivating the coils 234-236, adjusting a speed of the fan 238, or a combination of both.

Still referring to FIG. 2, the airside system 200 is shown to include the supervisory controller 266 and a client device 268. The supervisory controller 266 can include one or more computer systems (e.g., servers, supervisory controllers, subsystem controllers, etc.) that serve as system level controllers, application or data servers, head nodes, or master controllers for the airside system 200, the waterside system 120, the HVAC system 100, and/or other controllable systems that serve the building 10. The supervisory controller 266 may communicate with multiple downstream building systems or subsystems (e.g., the HVAC system 100, a security system, a lighting system, the waterside system 120, etc.) via a communications link 270 according to like or disparate protocols (e.g., LON, BACnet, etc.). In various embodiments, the AHU controller 230 and the supervisory controller 266 can be separate (as shown in FIG. 2) or integrated. In an integrated implementation, the AHU controller 230 can be a software module configured for execution by a processor of the supervisory controller 266.

In some embodiments, the AHU controller 230 receives information from the supervisory controller 266 (e.g., commands, setpoints, operating boundaries, etc.) and provides information to the supervisory controller 266 (e.g., temperature measurements, valve or actuator positions, operating statuses, diagnostics, etc.). For example, the AHU controller 230 may provide the supervisory controller 266 with temperature measurements from the temperature sensors 262-264, equipment on/off states, equipment operating capacities, and/or any other information that can be used by the supervisory controller 266 to monitor or control a variable state or condition within the building zone 206.

The client device 268 can include one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with the HVAC system 100, its subsystems, and/or devices. The client device 268 can be a computer workstation, a client terminal, a remote or local interface, or any other type of user interface device. The client device 268 can be a stationary terminal or a mobile device. For example, the client device 268 can be a desktop computer, a computer server with a user interface, a laptop computer, a tablet, a smartphone, a PDA, or any other type of mobile or non-mobile device. The client device 268 may communicate with supervisory controller 266 and/or the AHU controller 230 via a communications link 272.

Figure 3:
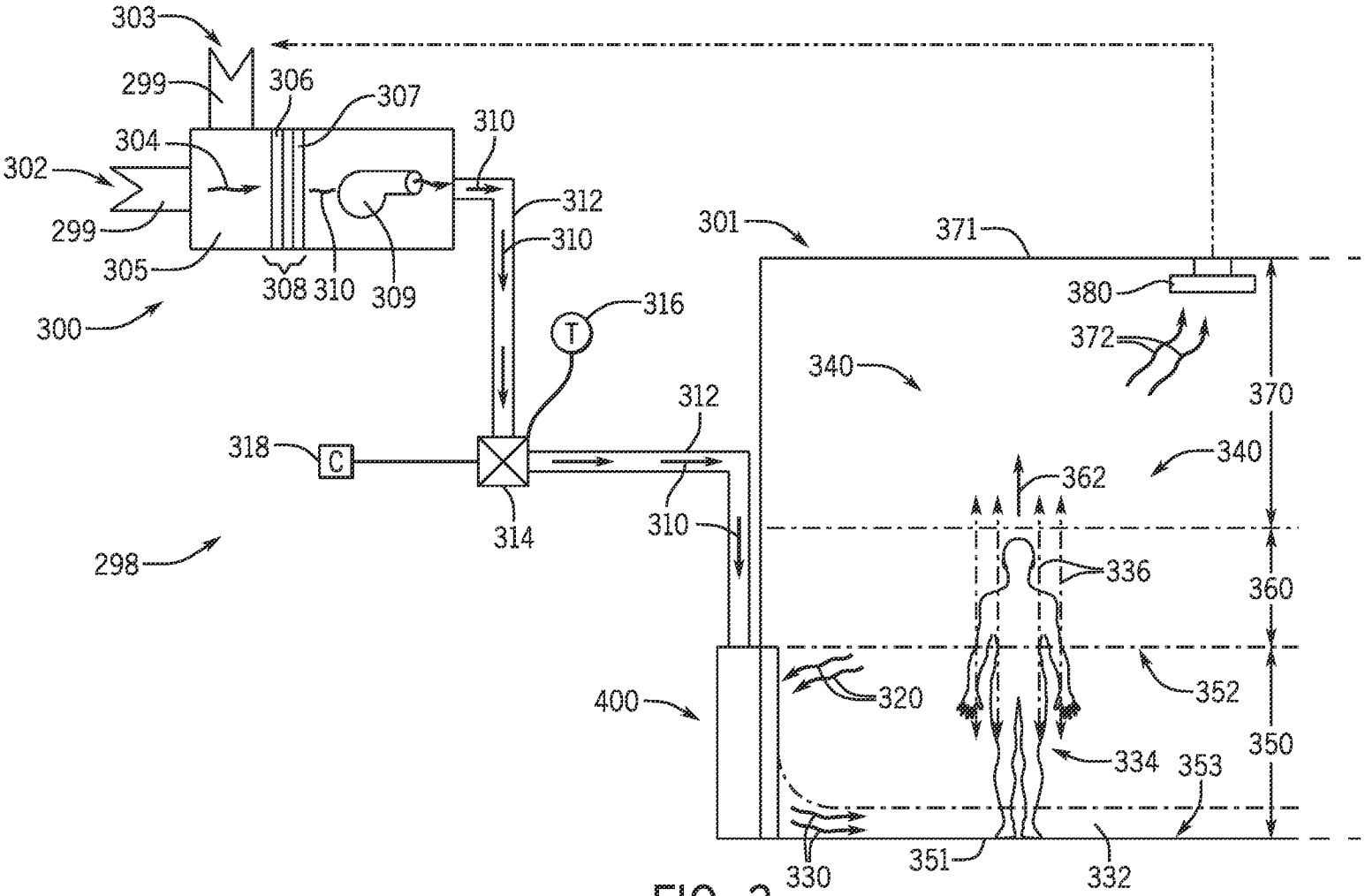
FIG. 3 is a schematic of an embodiment of an HVAC system including a displacement diffuser, in accordance with an aspect of the present disclosure.

Referring now to FIG. 3, a schematic of an embodiment of an HVAC system 298 including an air handling unit (AHU) 300 and a displacement diffuser 400 (e.g., thermal air displacement diffuser, air diffuser, thermal displacement diffuser) is shown, in accordance with aspects of the present disclosure. In various embodiments, the air handling unit 300 may supplement or replace the air handling unit 106 in the HVAC system 100 of FIG. 1 or the air handling unit 202 of the airside system 200 of FIG. 2 or can be implemented separate from the HVAC system 100 or the airside system 200. When implemented with the HVAC system 100 or with the airside system 200, the air handling unit 300 may include one or more of the devices in the AHUs 106, 202 (e.g., ducts, valves, actuators, dampers, fans, heat exchangers, heating coils, cooling coils, etc.) and/or may be located in or around the building 10 of FIG. 1 to heat or cool a room 301 (e.g., within the building 10). In the illustrated embodiment, the displacement diffuser 400 is disposed within and/or along a wall of the room 301, as well as adjacent a floor of the room 301.

As illustrated in FIG. 3, the HVAC system 298 may include ductwork 299 (e.g., conduits) configured to direct one or more air flows 302, 303 (e.g., outside air flow, return air flow) into the AHU 300, which may combine and mix in a mixing chamber 305 of the AHU 300 to form an air flow 304 (e.g., unconditioned air flow). The air flow 304 may be directed across a heating coil 306 and/or a cooling coil 307 (e.g., heat exchangers 308) via a fan 309. As described above with reference to the AHU 202 of FIG. 2, the AHU 300 may establish a heat exchange relationship between the air flow 304 and a working fluid (e.g., refrigerant) directed through the heat exchangers 308 as the air flow 304 is directed across the heat exchangers 308. In this way, the air flow 304 may be conditioned (e.g., dehumidified, heated, cooled) to produce a conditioned air flow 310. In some embodiments, the AHU 300 may be disposed in a humid environment (e.g., climate). Thus, it may be desirable to dehumidify the air flow 304, which may include outdoor air, by cooling the air flow 304 (e.g., to a threshold temperature, such as 54° F. or less) to remove a desired amount moisture from the air flow 304 before it is supplied to the room 301 or other conditioned space as the conditioned air flow 310.

The conditioned air flow 310 may be discharged from the AHU 300 and directed through ductwork 312 (e.g., supply air conduit) towards the displacement diffuser 400, which is disposed in, at, and/or adjacent the room 301. In some embodiments, the ductwork 312 may include an air volume control damper 314 configured to control an amount of the conditioned air flow 310 delivered to the displacement diffuser 400. The air volume control damper 314 may be communicatively coupled to one or more sensors 316 configured to provide feedback indicative of an operating parameter (e.g., temperature) of the conditioned air flow 310 directed through the ductwork 312. The air volume control damper 314 may also be communicatively coupled to a controller 318 configured to adjust a position of the air volume control damper 314 based on control commands or instructions received from the controller 318. For example, if the displacement diffuser 400 is not receiving a sufficient amount (e.g., a threshold amount) of the conditioned air flow 310 to sufficiently cool the room 301 based on a target temperature setpoint (e.g., to achieve a target temperature within the room 301), the controller 318 may send a command or instructions to adjust the air volume control damper 314 toward a partially or fully open position, thereby increasing the amount of the conditioned air flow 310 delivered to the displacement diffuser 400. In some embodiments, the controller 318 may receive sensor data from the one or more sensors 316 indicative of an operating parameter (e.g., temperature, flow rate) of the conditioned air flow 310, and based on the operating parameter of the conditioned air flow 310 being outside of a threshold range of parameter values (e.g., flow rate values, temperature values), being above a threshold parameter value, and/or being below a threshold parameter value, the controller 318 may adjust a position of the air volume control damper 314 to increase or decrease an amount of the air flow 310 delivered to the diffuser. In some operating conditions or circumstances (e.g., in a dehumidification mode of the HVAC system 298), the conditioned air flow 310 (e.g., the 54° F. air flow, the sub-cooled air flow) may be colder than desired for comfortable conditioning of the room 301. Accordingly, the displacement diffuser 400 is configured to mix the conditioned air flow 310 with warmer air (e.g., ambient air, room air) from the room 301, as described in greater detail below.

The room 301 may be an office space, a classroom, a conference room, or any other conditioned space, and may have a number of different portions (e.g., regions, zones), including a bottom portion 350, a breathing zone 360, and an upper portion 370. A position and/or dimension of the breathing zone 360 may be generally defined based on an average height of occupants 334 within the room 301 and/or an average position at which occupants 334 within a room breathe air within the room 301. For example, if the displacement diffuser 400 is employed in an elementary school classroom, the breathing zone 360 may be around 4 to 5 feet above floor level. However, if the displacement diffuser 400 is disposed within an office building or conference room (e.g., a building primarily occupied by adults), the breathing zone may be around 5 to 6 feet above floor level. In some embodiments, the breathing zone 360 may be characterized based on an average seated height of individuals within the room 301.

As occupants 334 within the room 301 exhale, respiratory contaminants may be expelled into the breathing zone 360. The bottom portion 350 may extend beneath the breathing zone 360, relative to gravity, such that any contaminants expelled into the breathing zone 360 are carried upwards and away from the bottom portion 350. Thus, the amount or presence of airborne contaminants within the bottom portion 350 of the room 301 may be limited. As colder air has a higher density than warmer air, the room 301 may have a temperature gradient from a floor 351 to a ceiling 371 of the room 301. That is, the temperature of the air in the room 301 may be colder (e.g., 61° F.) near the floor 351 and warmer (e.g., 83° F.) near the ceiling 371 of the room 301. Thus, the temperature of the air within the bottom portion 350 may be less than the temperature of the air within the breathing zone 360, and the temperature of the air within the breathing zone 360 (e.g., 76° F.) may be less than the temperature of the air within the upper portion 370 of the room 301. Due to the temperature gradient, air temperatures within a particular region, zone, or portion (e.g., bottom portion 350, breathing zone 360, upper portion 370) may also be lower (e.g., colder) the closer the air is to the floor 351. For example, within the bottom portion 350, the air closest to the floor 351 (e.g., near a bottom 353 of the bottom portion 350) may be at or near 61° F., while the air closest to the breathing zone 360 (e.g., near a top 352 of the bottom portion 350) may be at or near 73° F.

The displacement diffuser 400 may be positioned within the bottom portion 350 of the room 301 near (e.g., within a threshold distance from) or at the floor 351 of the room 301. As noted above, in humid environments, it may be desirable to dehumidify outdoor air (e.g., air flow 302) received by the AHU 300 to produce the conditioned air flow 310. More specifically, the outdoor air may be cooled (e.g., to 54° F. or less) to dehumidify the air and produce the conditioned air flow 310. However, due to the desired dehumidification, the conditioned air flow 310 may be cooled to a temperature that is lower than desired for occupants 334 within the room 301 (e.g., below a threshold temperature value). Thus, as the conditioned air flow 310 is directed into the displacement diffuser 400 via the ductwork 312, the displacement diffuser 400 is configured to draw in an induced air flow 320 from the bottom portion 350 of the room 301 (e.g., the top 352 of the bottom portion 350) to mix with the conditioned air flow 310 via induction, as described in greater detail below. The induced air flow 320 may be drawn from the top 352 of the bottom portion 350, and as such, may be warmer (e.g., 73° F.) than the conditioned air flow 310 (e.g., 54° F.). As described above, because the induced air flow 320 is drawn from the top 352 of the bottom portion 350 of the room 301, which is located below the breathing zone 360 relative to gravity, the induced air flow 320 may be substantially free (e.g., less than 1%, less than 5%) of airborne contaminants that may have been expelled into the breathing zone 360 by the occupants 334. The induced air flow 320 may mix with the conditioned air flow 310 in the displacement diffuser 400 to create a supply air flow 330 at a temperature (e.g., 61° F. or higher) that is suitable to be delivered to occupants 334 of the room 301 to provide conditioning via thermal displacement diffusion.

For instance, as the induced air flow 320 mixes with the conditioned air flow 310 within the displacement diffuser 400, pressure within the displacement diffuser 400 may increase. Thus, the supply air flow 330 may be discharged from the displacement diffuser 400 at a relatively low velocity (e.g., 50 to 100 feet per minute). As will be appreciated, the relatively low velocity of the supply air flow 330 exiting the displacement diffuser 400 mitigates mixing of the supply air flow 330 with surrounding room air 340 present in the breathing zone 360 and/or the upper portion 370 of the room 301. Because the supply air flow 330 is colder and has a higher density than the surrounding room air 340, the supply air flow 330 may disperse across the floor 351 to create a pool 332 (e.g., reservoir) of supply air 330 (e.g., fresh supply air, clean supply air, filtered supply air, etc.) across the floor 351. Indeed, the supply air flow 330 may be discharged from the displacement diffuser 400 vertically below the induced air flow 320 drawn into the displacement diffuser 400. As occupants 334 within the room 301 produce heat, convective air currents 336 may be created and may draw the supply air 330 upwards in a direction 362 from the pool 332 of supply air 330 and into the breathing zone 360. Further, as occupants 334 within the room 301 breathe, exhaled air, which may contain respiratory contaminants, may also rise up with the convective air currents 336 to the upper portion 370 of the room 301 and toward the ceiling 371.

The convective air currents 336 may combine to create an exhaust air flow 372 that may be removed from the room 301 via an exhaust vent 380 (e.g., exhaust duct, exhaust grille). In some embodiments, the exhaust air flow 372 may be discharged to an ambient or outside environment. In other embodiments, the exhaust vent 380 may be fluidly coupled to the AHU 300 (e.g., via the ductwork 299). Thus, the exhaust air flow 372 may be received by the AHU 300 as a return air flow (e.g., air flow 303), and the AHU 300 may filter and re-condition return air flow to generate the conditioned air flow 310.

By drawing in the induced air flow 320 from the bottom portion 350 of the room 301 beneath the breathing zone 360 to mix with the conditioned air flow 310 therein, the displacement diffuser 400 enables an increase in the temperature of the conditioned air flow 310 and/or supply air flow 330 without utilizing an additional heat exchanger or other heat exchange component that would otherwise increase manufacturing, operating, and/or maintenance costs of the HVAC system 298. For example, the AHU 300 may not include a dedicated reheat heat exchanger configured to operate during a dehumidification mode of the HVAC system 298. Additionally, the displacement diffuser 400 enables improved ventilation of the room 301 by drawing air from the bottom portion 350 of the room 301, which may be substantially free of airborne contaminants that may be present within the room 301, thereby reducing recirculation of airborne contaminants in the room 301.

Figure 4:
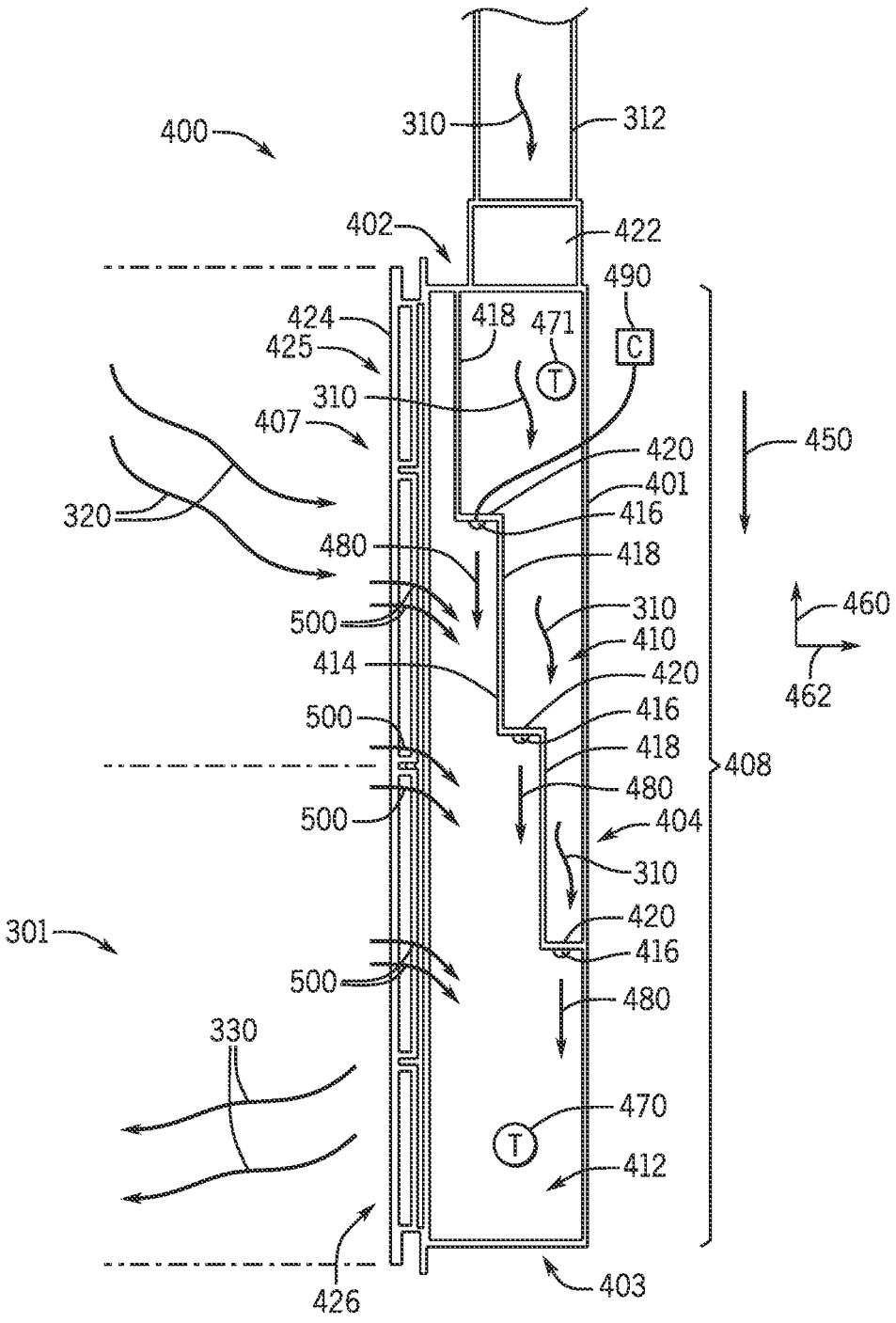
FIG. 4 is a cross-sectional side view of an embodiment of a displacement diffuser, in accordance with an aspect of the present disclosure.

Turning now to FIG. 4, a cross-sectional side view of an embodiment of the displacement diffuser 400, is shown, in accordance with aspects of the present disclosure. As illustrated, the displacement diffuser 400 may include a housing 401 that includes a first side 402 (e.g., a top side, top panel, top plate), a second side 403 (e.g., a bottom side, bottom panel, bottom plate), a third side 404 (e.g., back side, back panel, back plate), a fourth side 405 (e.g., side panel, side plate,), a fifth side 406 (e.g., side panel, side plate), and a sixth side 407 (e.g., front side, discharge side, discharge face). Each of the sides 402, 403, 404, 405, and 406 may be formed from sheet metal or any other suitable material and may be coupled together via welding, fasteners, or other suitable technique to at least partially define a plenum chamber 408 (e.g., interior volume). In some embodiments, one or more of the sides 402, 403, 404, 405, and 406 may be formed from a single piece of material that is machined or otherwise manipulated via another process (e.g., bending). The sixth side 407 may include a thermal diffusion plate 424 (e.g., panel, screen, sheet), and the thermal diffusion plate 424 may be coupled to the first, second, fourth, and fifth sides 402, 403, 405, 406 along the sixth side 407 to form the housing 401 and define the plenum chamber 408 (e.g., cavity, enclosure) within the housing 401. The thermal diffusion plate 424 may define a plurality of openings or apertures to enable an air flow to pass therethrough, thereby enabling the displacement diffuser 400 to both induce a flow of air from the room 301 into the displacement diffuser 400 and deliver air to the room 301 from the displacement diffuser 400 through the thermal diffusion plate 424, as described in greater detail below.

The plenum chamber 408 may be further divided into a high pressure chamber 410 (e.g., receiving chamber, first chamber, first volume) and a low pressure mixing chamber 412 (e.g., mixing chamber, second chamber, second volume) by a plenum plate 414 (e.g., plenum divider) disposed within the housing 401. That is, the plenum plate 414 may extend through the plenum chamber 408 to divide the plenum chamber 408 into two defined volumes (i.e., the high pressure chamber 410 and the low pressure mixing chamber 412). The volume of the high pressure chamber 410 may be less than the volume of the low pressure mixing chamber 412. In some embodiments, the plenum chamber 408 may include the plenum plate 414 and may not include a heat exchange component, such as a heat exchanger. For example, the high pressure chamber 410 and the low pressure mixing chamber 412 may be generally empty spaces configured to receive and discharge flows of air.

Figure 5:
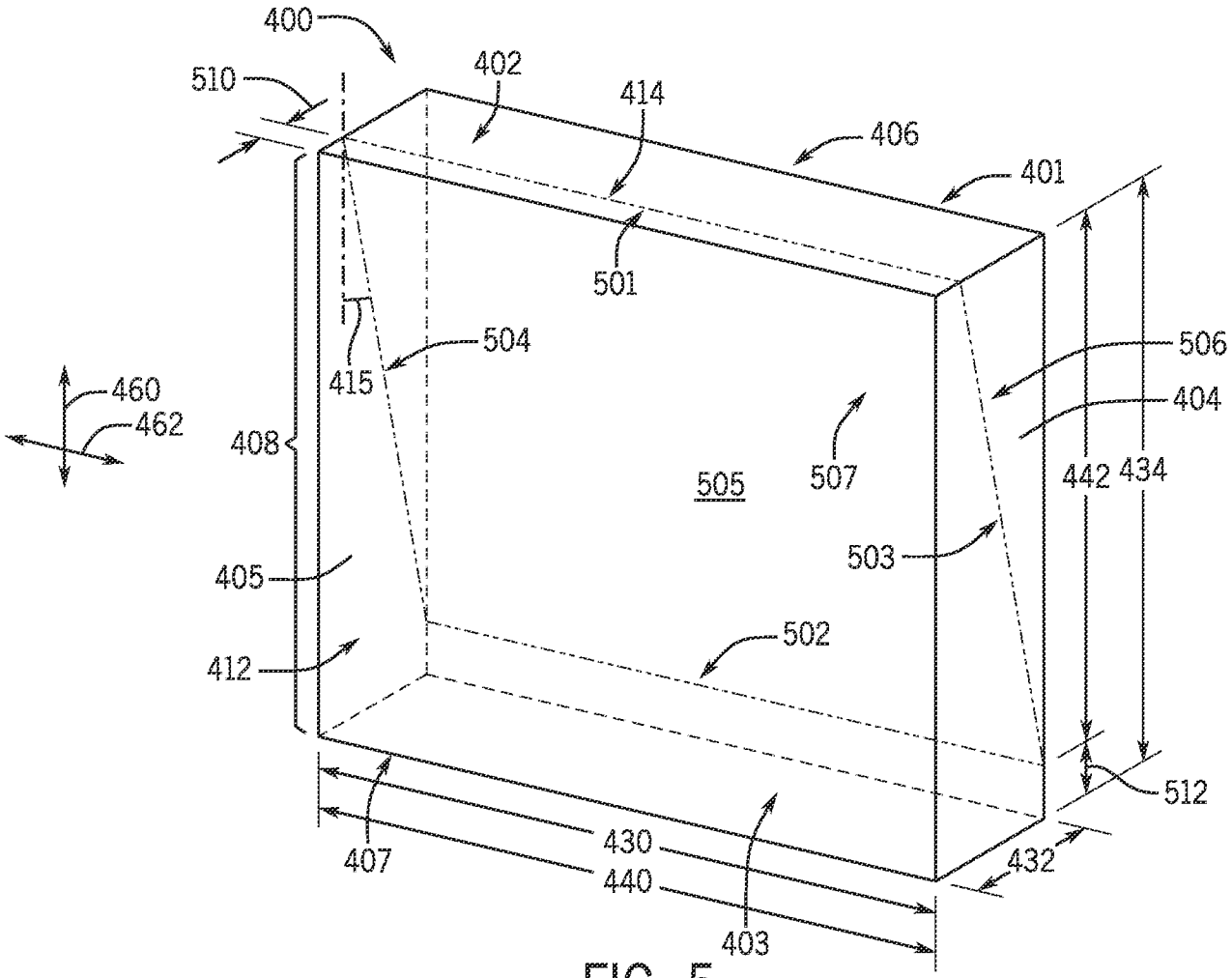
FIG. 5 is a simplified perspective view of an embodiment of a displacement diffuser, in accordance with an aspect of the present disclosure.

FIG. 5 is a simplified perspective view of an embodiment of displacement diffuser 400 including the plenum plate 414 extending through the plenum chamber 408, in accordance with aspects of the present disclosure. As illustrated in FIG. 5, the displacement diffuser 400 may have a width 430 extending from the third side 404 to the fourth side 405 of the housing 401, a depth 432 extending from the fifth side 406 to the sixth side 407 of the housing 401, and a height 434 extending from the first side 402 to the second side 403 of the housing 401. The plenum plate 414 may be formed from sheet metal or any suitable material and may include a first side 501 (e.g., top side, top edge), a second side 502 (e.g., bottom side, bottom edge), a third side 503 (e.g., first side edge), a fourth side 504 (e.g., second side edge), and a surface 505 (e.g., at least one surface) that includes a first side 506 (e.g., high pressure side) and a second side 507 (e.g., low pressure side). The plenum plate 414 may extend across and within the plenum chamber 408 to separate or divide the plenum chamber 408 into the high pressure chamber 410 and the low pressure mixing chamber 412. For example, the first side 501 of the plenum plate 414 may be configured to couple to the first side 402 of the housing 401 along the width 430 of the plenum chamber 408, the second side 502 may be configured to couple with the fifth side 406 of the housing 401, and the third and fourth sides 503, 504 may be configured to couple with the third and fourth sides 404, 405 of the housing 401, respectively.

As illustrated, the first side 501 of the plenum plate 414 may be coupled to the first side 402 of the housing 401 at a distance 510 from the sixth side 407 of the housing 401, and the second side 502 of the plenum plate 414 may be coupled to the fifth side 406 of the housing 401 at a distance 512 from the second side 403 of the housing 401. The surface 505 of the plenum plate 414 may extend at an angle 415 (e.g., relative to a first axis 460) away from the sixth side 407 and towards the fifth side 406. Thus, the plenum plate 414 may generally extend across the plenum chamber 408 from the first side 402 of the housing 401 to the fifth side 406 of the housing 401. The plenum plate 414 may also have a width 440 and a height 442. The width 440 of the plenum plate 414 may be approximately the same as the width 430 of the plenum chamber 408, and thus, the plenum plate 414 may extend along a second axis 462 across the plenum chamber 408 (e.g., an entirety of the plenum chamber 408). For example, the second axis 462 may generally extend in a direction of the supply air flow 330 discharged from the displacement diffuser 400. As noted above, because the second side 502 of the plenum plate 414 is configured to couple to the fifth side 406 of the housing 401 at the distance 512 away from the second side 403 of the housing 401, the height 442 of the plenum plate 414 may be less than the height 434 of the plenum chamber 408. In some embodiments, the plenum plate 414 may extend within and across the plenum chamber 408 such that a volume of the high pressure chamber 410 is less than a volume of the low pressure mixing chamber 412. Further, the position of the plenum plate 414 within the housing 401 may be modified, for example, by adjusting the distance 510 or the distance 512 at which the plenum plate 414 couples to the housing 401, thereby enabling adjustment of sizes of the respective volumes of the high pressure chamber 410 and a volume of the low pressure mixing chamber 412. In some embodiments, the respective volumes of the high pressure chamber 410 and a volume of the low pressure mixing chamber 412 may be selected based on target temperatures or ranges of target temperatures (e.g., set points) and/or conditioning (e.g., heating, cooling, ventilation, dehumidification) demands of the room 301 or other occupied space associated with the displacement diffuser 400. It should be noted that the discussion with respect to FIG. 5 is not intended to be limiting, and the plenum plate 414 may include any desirable shape, design, configuration, and/or orientation to facilitate providing the supply air flow 330 in a desired manner (e.g., at a desired temperature and/or flow rate) via the displacement diffuser 400.

Returning to FIG. 4, the plenum plate 414 may be formed from sheet metal or any other suitable material (e.g., non-corrosive material) and may include a plurality of apertures 416 (e.g., induction apertures, discharge apertures, nozzles, jets, etc.) formed therein and configured to direct the conditioned air flow 310 from the high pressure chamber 410 into the low pressure mixing chamber 412. The apertures 416 may be shaped such that a respective cross-sectional area of each aperture 416 decreases from an upstream portion of the aperture 416 to a downstream portion of the aperture 416 (e.g., relative to a direction of air flow through the aperture 416). In some embodiments, the plenum plate 414 may have a stepped arrangement and may include one or more first faces 418 (e.g., vertical faces, plates, faces without apertures, panels) that extend along a first axis 460 (e.g., a vertical axis extending along a direction of gravity, an axis extending in a direction 450 of the conditioned air flow 310 flowing into the displacement diffuser 400) and one or more second faces 420 (e.g., plates, panels, horizontal faces) that extend along a second axis 462 (e.g., a horizontal axis, an axis extending in a direction crosswise to the direction 450 of the conditioned air flow 310). The first faces 418 and the second faces 420 are arranged in an alternating arrangement to define a stepped configuration of the plenum plate 414. The apertures 416 may be disposed along the one or more second faces 420. In some embodiments, the apertures 416 may be ports, holes, or nozzles formed in the second faces 420, such as via punching or other forming process. Additionally or alternatively, the apertures 416 may include additional components (e.g., nozzles) secured or coupled to the one or more second faces 420 via fastening, welding, or any other suitable method. In some embodiments, each second face 420 may include an arrangement (e.g., row, array) of one, two, three, four, five, six, seven, eight or more apertures 416. Further, each second face 420 may include multiple rows (e.g., two rows, three rows, four rows, or more), with each row having multiple apertures 416 (e.g., one, two, three, four, five, six, seven, or more apertures 416). It should be noted that the examples above are non-limiting. Indeed, in other embodiments, the apertures 416 may have any suitable number, configuration, component, and so forth. In some embodiments, the first faces 418 and second faces 420 may be arranged or oriented in other configurations, as described further below.

The displacement diffuser 400 may also include a supply air inlet 422 (e.g., inlet port, inlet collar, etc.) fluidly coupled to the high pressure chamber 410. The supply air inlet 422 may also be fluidly coupled to the ductwork 312 and may be configured to receive the conditioned air flow 310. The conditioned air flow 310 directed into the high pressure chamber 410 of the plenum chamber 408 via the supply air inlet 422 may be pressurized. Upon reaching the high pressure chamber 410, the conditioned air flow 310 may be directed through the apertures 416 and into the low pressure mixing chamber 412 as jets of air flow. As noted above, the cross sectional area of the apertures 416 may decrease in a direction of air flow through the apertures 416 (e.g., from the first side 506 to the second side 507 of the plenum plate 414). Thus, the velocity of air flowing into the low pressure mixing chamber 412 from the high pressure chamber 410 through the apertures 416 may be increased. The increase in the velocity of air flowing into the low pressure mixing chamber 412 creates an induction effect 500, which causes air within the low pressure mixing chamber 412 and within the room 301 to be drawn towards the air discharged by the apertures 416. In this way, mixing of the air discharged by the apertures 416 (e.g., conditioned air flow 310) and air within the low pressure mixing chamber 412 (e.g., drawn from the room 301) is enabled.

As illustrated in FIG. 4, the conditioned air flow 310 flowing through the apertures 416 may draw the induced air flow 320 from within the room 301 through an upper portion 425 of the thermal diffusion plate 424 and into the low pressure mixing chamber 412 via the induction effect 500. The induced air flow 320 may then mix with the conditioned air flow 310 that is directed into the low pressure mixing chamber 412 via the apertures 416. That is, as the air velocity of the conditioned air flow 310 increases by flowing through the apertures 416, one or more high velocity air flows 480 of the conditioned air flow 310 are created and directed into the low pressure mixing chamber 412 in the direction 450 towards the second side 403 of the housing 401. As the one or more high velocity air flows 480 are directed from the apertures 416, the high velocity air flows 480 pass through air within the low pressure mixing chamber 412 and cause the air to move along (e.g., mix) with the high velocity air flows 480 in the direction 450. This, in turn, generates the induction effect 500, which causes the induced air flow 320 (e.g., from the bottom portion 350 of the room 301) to be entrained through the upper portion 425 of the thermal diffusion plate 424 and into the low pressure mixing chamber 412 (e.g., in a direction crosswise to the direction 450 of the conditioned air flow 310, in a direction crosswise to the direction 450 of the high velocity air flows 480, in a direction along the second axis 462). As noted above, the induced air flow 320, which may additionally or alternatively be drawn from the top 352 of the bottom portion 350 beneath the breathing zone 360 relative to gravity, may be warmer than the conditioned air flow 310 directed into the low pressure mixing chamber 412 via the apertures 416. For example, the conditioned air flow 310 may be cooled to a temperature of 54° F. by the AHU 300, while the induced air flow 320 from the bottom portion 350 of the room 301 may be near 73° F. By drawing the induced air flow 320 into the low pressure mixing chamber 412 via the induction effect 500, the warmer induced air flow 320 transfers heat to the conditioned air flow 310, thereby enabling the displacement diffuser 400 to produce the supply air flow 330 at a suitable temperature for comfortable conditioning of the room 301 (e.g., near 61° F., via thermal diffusion). In some embodiments, the supply air flow 330 may be discharged from the displacement diffuser 400 in a direction crosswise to the direction 450 of the conditioned air flow 310 (e.g., in a direction along the second axis 462, in a direction crosswise to the direction 450 of the high velocity air flows 480).

In some embodiments, the displacement diffuser 400 may include one or more sensors (e.g., temperature sensor, pressure sensor) configured to provide feedback indicative of the conditions of air within the plenum chamber 408. For example, the low pressure mixing chamber 412 may include a temperature sensor 470 configured to provide temperature data of the air present within the low pressure mixing chamber 412, and the high pressure chamber 410 may include a temperature sensor 471 configured to provide temperature data of the air present within the high pressure chamber 410. The temperature sensor 470 may provide data indicating that the temperature of the air within the low pressure mixing chamber 412 is unsuitable (e.g., too hot, too cold) to adequately or desirably condition the room 301. Further, in some embodiments, the apertures 416 may include adjustable nozzles (e.g., actuatable nozzles) communicatively coupled to a controller 490 that is configured to control a size of the apertures 416. The controller 490 may therefore adjust the nozzles to control a flow rate and/or a velocity of the air directed through the apertures 416, thereby enabling control of an amount of heat exchange and/or mixing of the conditioned air flow 310 and the induced air flow 320 within the displacement diffuser 400. For example, the temperature sensor 470 may provide an indication that the temperature of the air present within the low pressure mixing chamber 412 is below a threshold value (e.g., 60° F.). Based on the temperature of the air in the low pressure mixing chamber 412 being below the threshold value, the controller 490 may output a command to reduce the amount of the conditioned air flow 310 supplied to the low pressure mixing chamber 412 by reducing a size of the apertures 416 (e.g., adjust nozzles toward a closed position). In some embodiments, the controller 318 discussed above may be configured to operate the air volume control damper 314 to reduce the amount of the conditioned air flow 310 delivered to the high pressure chamber 410. As an amount of the conditioned air flow 310 directed into the low pressure mixing chamber 412 via the apertures 416 decreases, the temperature of the air within the low pressure mixing chamber 412 (e.g., the supply air flow 330) may increase.

In some embodiments, the controller 490 may be configured to adjust sizes of the apertures 416 to increase the velocity of the high velocity air flows 480, such as based on the temperature of the air within the low pressure mixing chamber 412 being below a threshold value. By increasing the velocity of the high velocity air flows 480, the generated induction effect 500 may be increased, and a larger volume of the induced air flow 320 may be drawn into the low pressure mixing chamber 412. As the induced air flow 320 is warmer than the conditioned air flow 310, an increased volume of the induced air flow 320 drawn into the low pressure mixing chamber 412 may cause the temperature of the air present within the low pressure mixing chamber 412 to increase. Such control and feedback techniques enable a user to modify an amount of the induced air flow 320 drawn into the displacement diffuser 400 and/or modify an amount of the conditioned air flow 310 directed into the low pressure mixing chamber 412, which thereby enables control of the amount of heat exchange between the induced air flow 320 and the conditioned air flow 310.

As noted above, as the conditioned air flow 310 and the induced air flow 320 are directed or drawn into the low pressure mixing chamber 412, the volume of air within the low pressure mixing chamber 412 increases, which also causes the pressure within the low pressure mixing chamber 412 to increase. Further, as the conditioned air flow 310 and the induced air flow 320 are mixed together via the induction effect 500, the air flows 310, 320 may combine to form the supply air flow 330. Accordingly, the supply air flow 330 may be directed out of the lower portion 426 of the thermal diffusion plate 424 and into the room 301 to condition the room 301.

Figure 6:
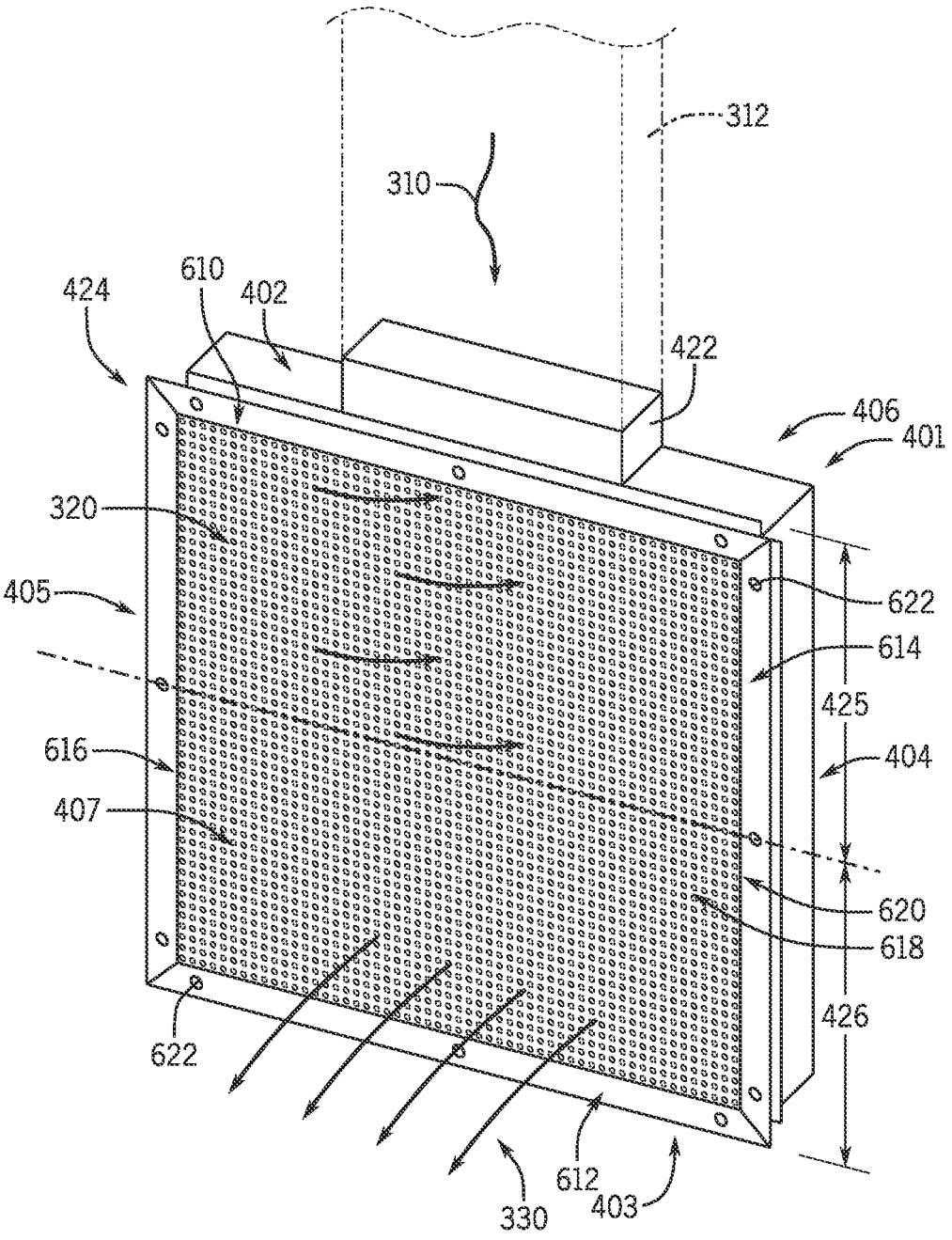
FIG. 6 is a perspective view of an embodiment of a displacement diffuser, in accordance with an aspect of the present disclosure.

Turning now to FIG. 6, a perspective view of an embodiment of the displacement diffuser 400 is shown, in accordance with aspects of the present disclosure. As illustrated, the displacement diffuser 400 includes the thermal diffusion plate 424 disposed on the sixth side 407 of the displacement diffuser 400. As noted above, the thermal diffusion plate 424 may include the upper portion 425 and the lower portion 426. The thermal diffusion plate 424 may also include a first side 610 (e.g., top side), a second side 612 (e.g., bottom side), a third side 614, a fourth side 616, and a surface 618. The surface 618 of the thermal diffusion plate 424 may be configured to entrain and discharge different air flows (e.g., induced air flow 320, room supply air flow 330). For example, the thermal diffusion plate 424 may be a mesh, a screen, or a plate (e.g., a perforated plate) with apertures or holes formed in and extending through the surface 618. The thermal diffusion plate 424 may also include a lip 620 disposed about the surface 618 (e.g., about a perimeter of the surface 618) along each of the sides 610, 612, 614, 616 of the thermal diffusion plate 424. The lip 620 may be configured to couple the thermal diffusion plate 424 to the housing 401 of the displacement diffuser 400 via fasteners 622. It should be noted the example above is not intended to be limiting, and the thermal diffusion plate 424 may have other orientations and configurations configured to enable flow of air therethrough (e.g., into the plenum chamber 408 and out of the plenum chamber 408).

Figures 7A, 7B, 7C:
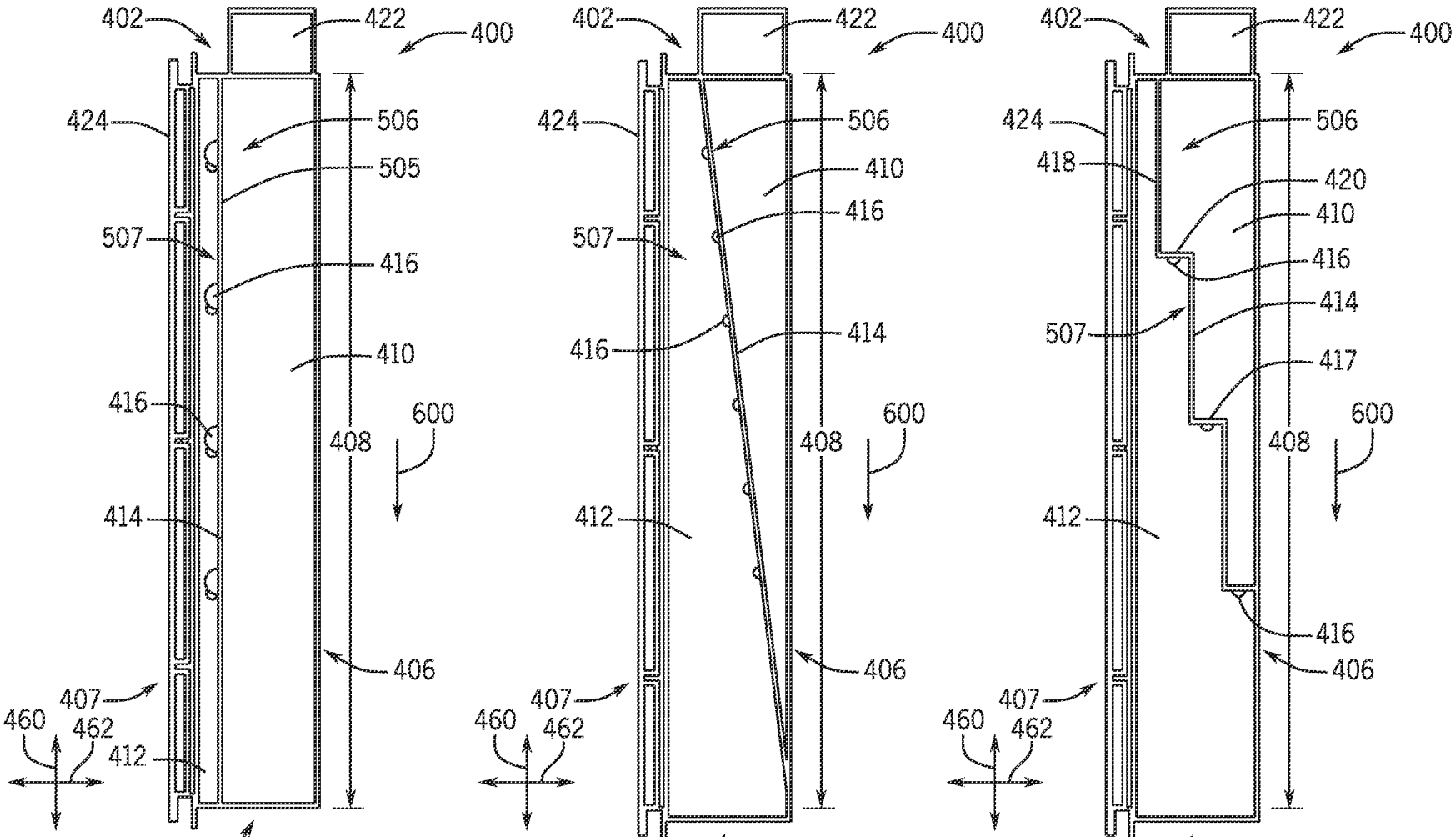
FIG. 7A is a cross-sectional side view of an embodiment of a displacement diffuser, in accordance with an aspect of the present disclosure.
FIG. 7B is a cross-sectional side view of an embodiment of a displacement diffuser, in accordance with an aspect of the present disclosure.
FIG. 7C is a cross-sectional side view of an embodiment of a displacement diffuser, in accordance with an aspect of the present disclosure.

Turning now to FIGS. 7A-7F, various cross-sectional side views of embodiments of the displacement diffuser 400 having the plenum plate 414 in different configurations and/or orientations within the displacement diffuser 400 are shown, in accordance with aspects of the present disclosure. It should be noted that the following examples are not intended to be limiting, and the plenum plate 414 may have other orientations or designs that may provide the benefits disclosed herein. For example, FIG. 7A illustrates an embodiment of the displacement diffuser 400 having the plenum plate 414 with a molded (e.g., molded polymer) aperture design. As illustrated, in some embodiments, the plenum plate 414 may generally extend along the first axis 460 from the first side 402 of the housing 401 to the second side 403 of the housing 401. The apertures 416 may be disposed along the second side 507 of the surface 505 of the plenum plate 414 and may direct the conditioned air flow 310 from the high pressure chamber 410 into the low pressure mixing chamber 412 in a direction 600 (e.g., a generally downward direction), thereby creating the induction effect 500 discussed above.

FIG. 7B illustrates an embodiment of the displacement diffuser 400 having the plenum plate 414 with a sloped configuration extending across the plenum chamber 408. As illustrated, the sloped plenum plate 414 may extend at an angle relative to the first axis 460 (e.g., vertical axis) from the first side 402 of the housing 401 to the fifth side 406 of the housing 401, and the apertures 416 may be disposed along the first side 507 of the surface 505 of the sloped plenum plate 414. Similar to FIG. 7A above, the apertures 416 may be configured to direct the conditioned air flow 310 in the direction 600 towards the second side 403 of the housing 401, thereby creating the induction effect 500.

FIG. 7C illustrates an embodiment of the displacement diffuser 400 having the plenum plate 414 with a stepped configuration extending through the plenum chamber 408. As similarly discussed above with reference to FIG. 4, the plenum plate 414 having the stepped configuration may include one or more first faces 418 (e.g., vertically extending plates or panels, plates or panels extending along the first axis 460) that may not include apertures 416 and one or more second faces 420 (e.g., horizontally extending plates or panels, plates or panels extending along the second axis 462). An arrangement 417 (e.g., a row) of the apertures 416 may be disposed along each of the second faces 420 to direct the conditioned air flow 310 into the low pressure mixing chamber 412 in the direction 600. It should be noted that each arrangement 417 of apertures 416 may include one, two, three, four, five, six, seven, eight, or more apertures 416.

Figure 7F:
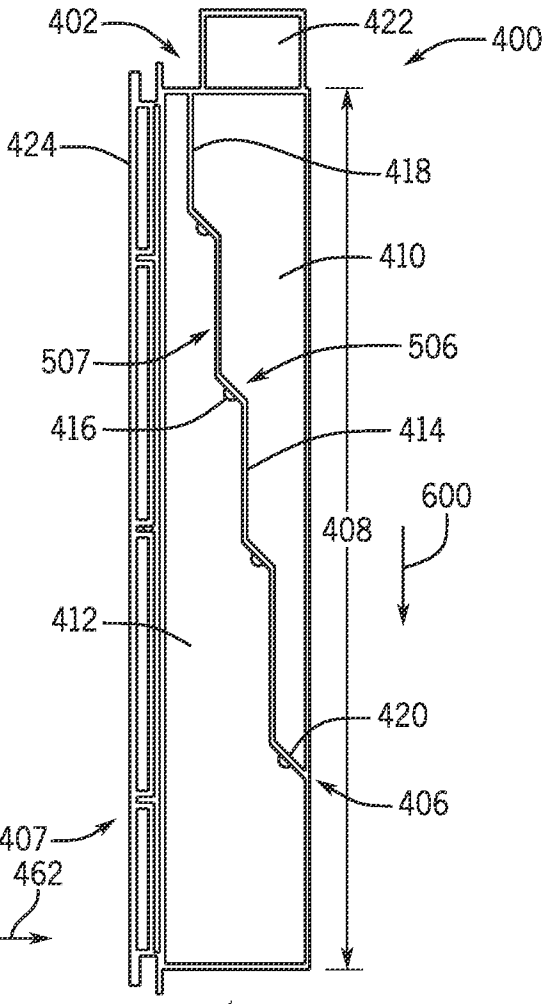
FIG. 7F is a cross-sectional side view of an embodiment of a displacement diffuser, in accordance with an aspect of the present disclosure.
Figure 7E:
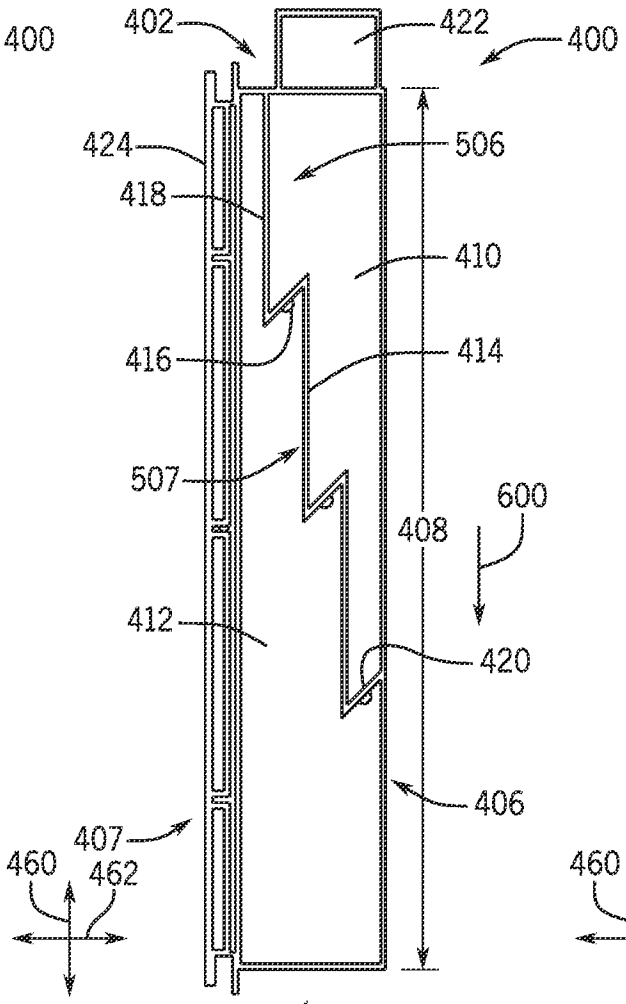
FIG. 7E is a cross-sectional side view of an embodiment of a displacement diffuser, in accordance with an aspect of the present disclosure.
Figure 7D:
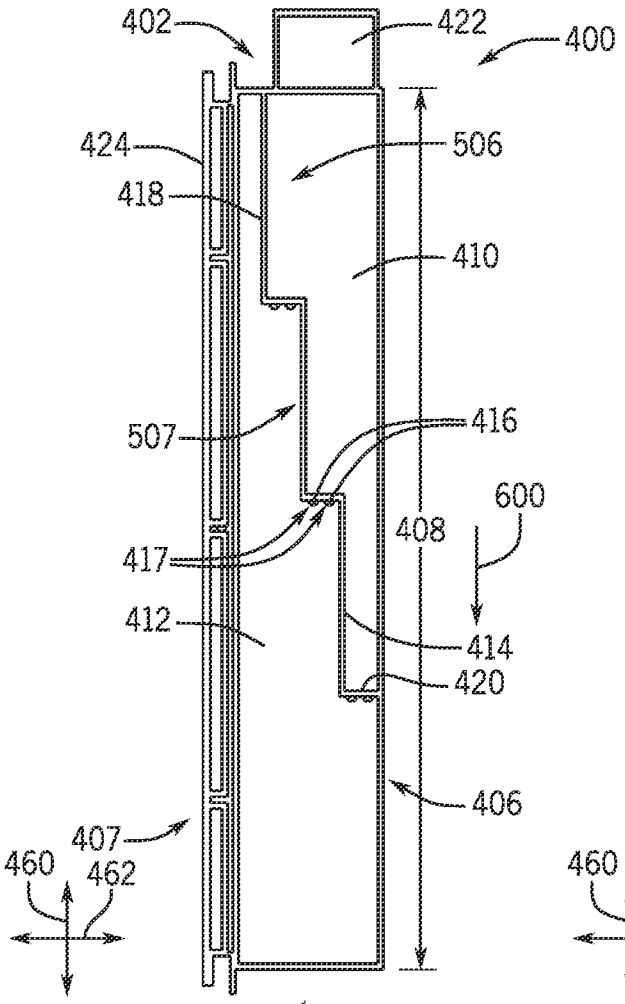
FIG. 7D is a cross-sectional side view of an embodiment of a displacement diffuser, in accordance with an aspect of the present disclosure.

FIG. 7D illustrates another embodiment of the displacement diffuser 400 having the plenum plate 414 in another stepped configuration. Similar to FIG. 7C above, the plenum plate 414 of FIG. 7D may include one or more first faces 418 (e.g., vertically extending plates or panels, plates or panels extending along the first axis 460) and one or more second faces 420 (e.g., horizontally extending plates or panels, plates or panels extending along the second axis 462). Further, in the illustrated embodiment, each second face 420 includes two arrangements 417 (e.g., rows) of apertures 416. However, in other embodiments, one or more of the second faces 420 may include three, four, or more arrangements 417 of the apertures 416, and each arrangement 417 may include one, two, three, four, five, six, seven, eight, or more apertures 416 in any suitable configuration.

FIG. 7E illustrates an embodiment of the displacement diffuser 400 having the plenum plate 414 with a back-slanted stepped configuration. The plenum plate 414 of the illustrated embodiment includes one or more first faces 418 extending along the first axis 460 and one or more second faces 420. The one or more second faces 420 are disposed at an angle relative to the first axis 460 (e.g., vertical axis) and the second axis 462 (e.g., horizontal axis). One or more arrangements 417 (e.g., rows) of apertures 416 may be disposed along each of the second faces 420, and the apertures 416 may direct the conditioned air flow 310 towards both the second side 403 of the housing 401 and the fifth side 406 of the housing 401 (e.g., at least partially in a direction generally opposite a direction of the supply air flow 330 discharged by the displacement diffuser 400, in a direction away from the room 301).

FIG. 7F illustrates an embodiment of the displacement diffuser 400 having the plenum plate 414 with a front-slanted configuration. The plenum plate 414 of the illustrated embodiment also includes one or more first faces 418 (e.g., vertically extending plates or panels, plates or panels extending along the first axis 460), as well as one or more second faces 420. The one or more second faces 420 are disposed at an angle relative to the first axis 460 (e.g., vertical axis) and the second axis 462 (e.g., horizontal axis). One or more arrangements 417 of apertures 416 may be disposed along each of the front-slanted faces 420, and the apertures 416 may direct the conditioned air flow 310 towards the second side 403 and toward the sixth side 407 of the housing 401 (e.g., at least partially in a direction of the supply air flow 330 discharged by the displacement diffuser 400, in a direction toward the room 301 and/or the thermal diffusion plate 424).

As noted above, the displacement diffuser 400 may include any number of apertures 416 and arrangements 417 as desired to enable the displacement diffuser 400 to draw relatively warm arm (e.g., induced air flow 320) into the low pressure mixing chamber 412 to mix with relatively cool air (e.g., conditioned air flow 310), thereby enabling the displacement diffuser 400 to provide the supply air flow 330 at a desired temperature (e.g., without utilization of a separate heat exchange component, such as a heat exchange coil). Further, the examples above are not intended to be limiting, and a number of different orientations and configurations of the plenum plate 414, the apertures 416, and the arrangements 417 may be employed with the present techniques.

Figure 8:
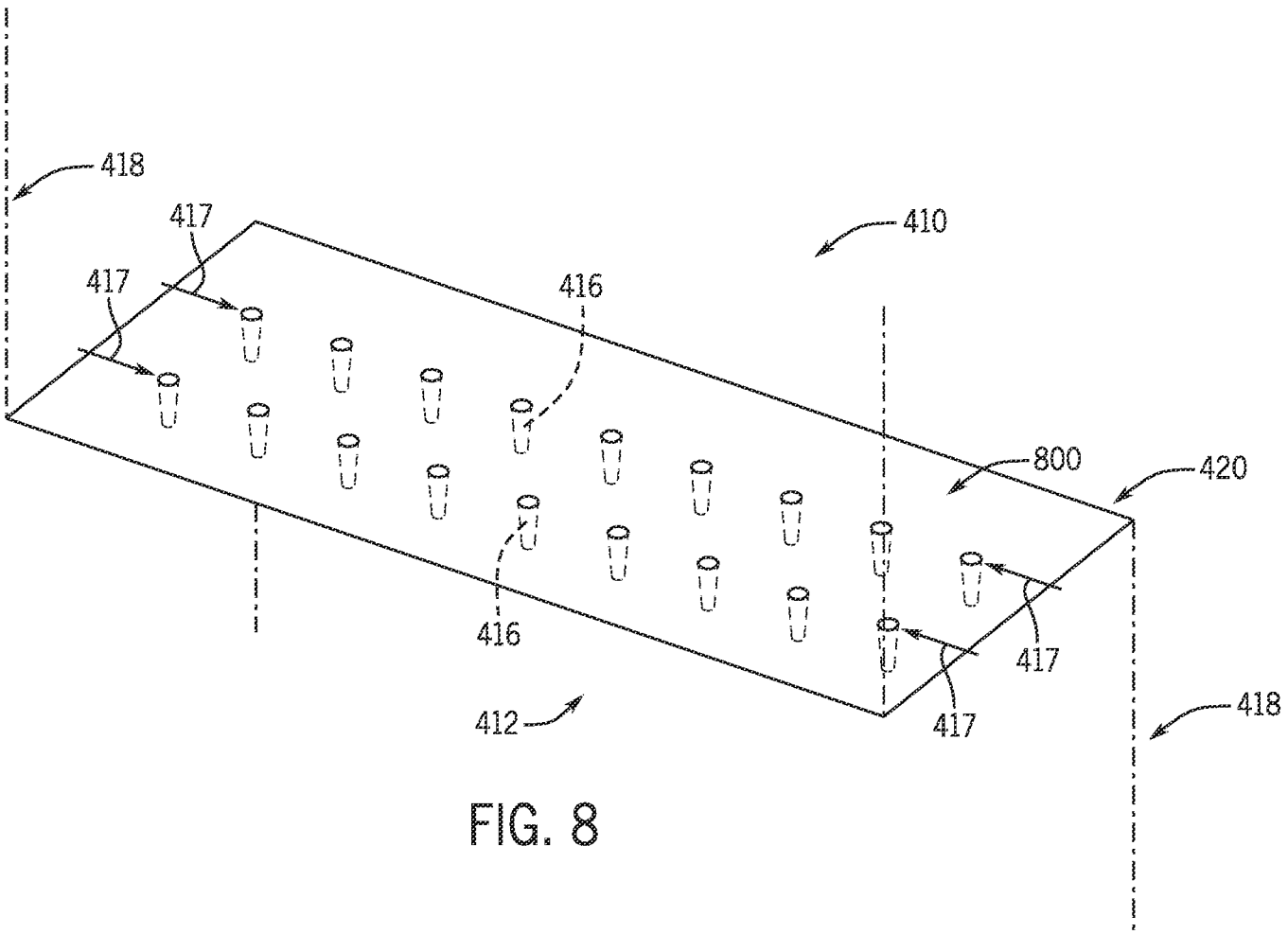
FIG. 8 is a perspective view of an embodiment of a plenum plate of a displacement diffuser, in accordance with an aspect of the present disclosure.

Turning now to FIG. 8, a perspective view of an embodiment of one of the second faces 420 of the plenum plate 414 is shown, in accordance with aspects of the present disclosure. As illustrated, the second face 420 may include one or more arrangements 417 of apertures 416 configured to direct an air flow (e.g., conditioned air flow 310) from the high pressure chamber 410 to the low pressure mixing chamber 412. For example, the apertures 416 may extend through a surface 800 of the second face 420, thereby enabling air flows or jets to be directed through the second face 420 and into the low pressure mixing chamber 412.

The displacement diffuser described herein enables improved operation of an HVAC system to provide conditioned air, such as dehumidified air, to a space at a desirable temperature. In particular, the disclosed techniques enable heating of a cooled conditioned air flow by entraining warmer, induced air from a room into the displacement diffuser and mixing the warmer, induced air with the cooled conditioned air flow, thereby creating a supply air flow at a desired temperature via mixing of the cooled conditioned air flow and the induced air flow. Indeed, the displacement diffuser disclosed herein does not utilize additional heat exchange components (e.g., heat wheel, additional heat exchanger, reheat heat exchanger, etc.) to produce and provide a supply air flow having a desired temperature and humidity level. In the manners described above, the displacement diffuser enables an increase in efficiency of an HVAC system (e.g., fewer components operating and/or consuming power), a decrease in costs of an HVAC system (e.g., fewer components to install, manufacture, and maintain), and an increase in ventilation of air in a room having the displacement diffuser.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A diffuser for a heating, ventilation, and air conditioning (HVAC) system, comprising:

a housing defining a plenum chamber, wherein the housing comprises a diffusion plate configured to direct a first air flow into the plenum chamber and to discharge a second air flow from the plenum chamber;

a plenum plate disposed within the housing, wherein the plenum plate extends from a first side of the housing to a second side of the housing opposite the first side, and the plenum plate divides the plenum chamber into a first chamber and a second chamber; and a plurality of apertures disposed along the plenum plate, wherein the plurality of apertures is configured to direct a third air flow from the first chamber into the chamber draw the first air flow into the plenum chamber and to force the second air flow out of the plenum chamber, wherein the housing comprises a top panel, and the plenum plate is coupled to and extends from the top panel.

2. The diffuser of claim 1, wherein the diffuser is configured to discharge the first air flow and the third air flow from the plenum chamber as the second air flow.

3. The diffuser of claim 2, wherein the diffuser is configured to mix the first air flow and the third air flow within the second chamber to produce the second air flow.

4. The diffuser of claim 3, wherein the diffuser comprises an inlet configured to receive a conditioned air flow via ductwork as the third air flow, and the inlet is configured to direct the third air flow into the first chamber.

5. The diffuser of claim 1, wherein the diffusion plate is configured to direct the first air flow into the second chamber and to discharge the second air flow from the second chamber.

6. The diffuser of claim 5, wherein the diffuser is configured to discharge the second air flow from the second chamber via the diffusion plate vertically below the first air flow received by the diffuser via the diffusion plate.

7. A diffuser for a heating, ventilation, and air conditioning (HVAC) system, comprising:

a housing defining a plenum chamber, wherein the housing comprises a diffusion plate configured to direct a first air flow into the plenum chamber and to discharge a second air flow from the plenum chamber;

a plenum plate disposed within the housing, wherein the plenum plate extends from a first side of the housing to a second side of the housing opposite the first side, and the plenum plate divides the plenum chamber into a first chamber and a second chamber; and a plurality of apertures disposed along the plenum plate, wherein the plurality of apertures is configured to direct a third air flow from the first chamber into the chamber draw the first air flow into the plenum chamber and to force the second air flow out of the plenum chamber, wherein the plenum plate comprises a plurality of first panels and a plurality of second panels arranged in an alternating arrangement.

8. The diffuser of claim 7, wherein each first panel of the plurality of first panels extends along a direction of the third air flow directed into the plenum chamber, and each second panel of the plurality of second panels extends crosswise to the direction of the third air flow.

9. The diffuser of claim 8, wherein the plurality of apertures is formed in the plurality of second panels.

10. The diffuser of claim 9, wherein each second panel of the plurality of second panels extends in a direction of the second air flow discharged from the plenum chamber.

11. A heating, ventilation, and air conditioning (HVAC) system, comprising:

a diffuser configured to receive a first air flow from an air handling unit via ductwork;

a housing of the diffuser, wherein the housing defines an interior chamber and comprises a diffusion plate;

a plenum plate of the diffuser, wherein the plenum plate is disposed within the housing and divides the interior chamber into a first chamber and a second chamber, and the plenum plate comprises a stepped configuration with a plurality of first panels and a plurality of second panels disposed in an alternating arrangement; and a plurality of apertures formed in the plurality of second panels of the plenum plate, wherein the plurality of apertures is configured to direct the first air flow from the first chamber to the second chamber to induce a second air flow into the interior chamber and to discharge a third air flow from the interior chamber.

12. The HVAC system of claim 11, wherein the plurality of apertures is configured to direct the first air flow from the first chamber to the second chamber along a first axis, and the diffusion plate is configured to direct the second air flow into the interior chamber and discharge the third air flow from the interior chamber along a second axis crosswise to the first axis.

13. The HVAC system of claim 12, wherein the housing comprises an inlet configured to direct the first air flow into the first chamber along the first axis.

14. The HVAC system of claim 11, wherein the diffusion plate is configured to direct the second air flow into the second chamber and to discharge the third air flow from the second chamber.

15. The HVAC system of claim 11, wherein a first volume of the first chamber is less than a second volume of the second chamber.

16. The HVAC system of claim 11, wherein the plurality of apertures comprises a plurality of nozzles.

17. A heating, ventilation, and air conditioning (HVAC) system, comprising:

an air handling unit configured to provide a first air flow; and a diffuser configured to receive the first air flow, induce a second air flow from a conditioned space and into the diffuser, and discharge a third air flow from the diffuser to the conditioned space, wherein the diffuser comprises:

a housing defining a plenum chamber;

a plenum plate configured to divide the plenum chamber into a first chamber and a second chamber; and a plurality of apertures formed in the plenum plate and configured to direct the first air flow from the first chamber to the second chamber to induce the second air flow and to discharge the third air flow, wherein the diffuser is configured to discharge the third air flow vertically below the second air flow induced into the diffuser, wherein the plenum plate extends from a top panel of the housing, the plenum plate comprises a stepped arrangement having a first plurality of panels and a second plurality of panels in an alternating arrangement, the first plurality of panels extend along a first direction of the first air flow received by the diffuser, the second plurality of panels extend along a second direction crosswise to the first direction, and the plurality of apertures is formed in the second plurality of panels.

18. The HVAC system of claim 17, the diffuser is configured to be positioned along a wall of the conditioned space and is configured to discharge the third air flow along a floor of the conditioned space.

* * * * *